US005957165A

United States Patent [19]

Watanabe et al.

[11] Patent Number: 5,957,165

[45] Date of Patent: Sep. 28, 1999

[54] APPARATUS FOR WINDING AND TIGHTENING A BAND CLIP AROUND A WIRING HARNESS

[75] Inventors: Kunihiko Watanabe; Ken Takahashi, both of Yokkaichi, Japan

[73] Assignee: Sumitomo Wiring Systems, Ltd., Japan

[21] Appl. No.: 08/990,685

[22] Filed: Dec. 15, 1997

[51] Int. Cl.[6] ..... B21F 9/02

[52] U.S. Cl. ..... 140/123.6; 140/93.2

[58] Field of Search ..... 140/93 A, 93.2, 140/123.6

[56] References Cited

U.S. PATENT DOCUMENTS

| | | | |
|---|---|---|---|
| 4,119,124 | 10/1978 | Collier et al. | 140/123.6 |
| 4,561,475 | 12/1985 | Hinden . | |
| 4,793,385 | 12/1988 | Dyer et al. . | |
| 5,417,252 | 5/1995 | Kurmis . | |
| 5,584,452 | 12/1996 | Koike . | |
| 5,601,261 | 2/1997 | Koike . | |

FOREIGN PATENT DOCUMENTS

| | | |
|---|---|---|
| 0 297 337 | 1/1989 | European Pat. Off. . |
| 0 390 434 | 10/1990 | European Pat. Off. . |
| 1.371.184 | 7/1964 | France . |

*Primary Examiner*—Lowell A. Larson
*Attorney, Agent, or Firm*—Anthony J. Casella; Gerald E. Hespos; Ludomir A. Budzyn

[57] ABSTRACT

An apparatus for winding and tightening a band clip (10) around a wiring harness (1) is provided with a base member (100) with a clip retaining means (120) for retaining a clip portion (2) of the band clip (10) in such a manner that a clipping direction (A) and a receiving direction (B) of a band receiving portion (3) extend substantially parallel to each other; a band tip deflecting member (200), movable with respect to the base member (100), for deflecting a band tip (6) of the band clip (10) around the wiring harness (1) towards and through the band receiving portion (3) by reducing the distance between the base member (100) and the band tip deflecting member (200); and a band tightening member (300), movable with respect to the base member (100), for gripping and pulling the band tip (6) having passed the band receiving portion (3) to tighten the band portion (4) by increasing the distance between the base member (100) and the band tightening member (300). This apparatus allows a high degree of automation, highly regular and uniform winding, and tightening of several band clips around a wiring harness and a high operability in connection with the production of wiring harnesses where a minimum working space is sometimes available for winding and tightening the band clips.

13 Claims, 9 Drawing Sheets

APPARATUS FOR WINDING AND TIGHTENING A BAND CLIP AROUND A WIRING HARNESS

BACKGROUND OF THE INVENTION

1. Field of the Invention

The present invention concerns an apparatus for winding and tightening a band clip around a wiring harness or the like.

2. Description of the Prior Art

Plastic ties including a band and a band receiving head are known and have long been used for tying cables, to form wiring harnesses or the like. Those prior art ties also were used to fix a wiring harness to a structural component of a body of, for instance, a motor vehicle. However, in recent years, there has arisen a need to provide such ties that easily can be inserted and locked by means of a clip or clipping head which can be inserted in an appropriate hole or recess in, for instance, a part of the body of a motor vehicle. Such ties are called band clips and can be classified into two types. One type of prior art band clip is such that the clipping direction and the direction in which a band receiving portion receives a band are substantially perpendicular to each other. Such a band clip is disclosed in U.S. Pat. No. 5,601,261. This known band clip is substantially formed by arranging a clipping portion at a right angle to the band receiving portion. Tools as disclosed in EP-A-0 390 434 or U.S. Pat. No. 4,793,385 may be used for winding and tightening such band clips.

The other type of band clip is disclosed in U.S. Pat. No. 5,584,452. Such a band clip, as also illustrated in FIGS. 1 and 2 of the present application, substantially comprises a band portion 4 and a clipping head 2 which is provided with a band receiving portion 3 for receiving a tip 6 of the band portion 4. This second type of band clip is distinguished from the aforementioned type by the fact that the clipping direction or the direction in which the clipping head 2 is inserted in a suitable opening or recess is substantially parallel to the receiving direction of the band receiving portion 3. In particular, the band portion 4 is substantially aligned with the clipping head 2 as illustrated in FIG. 2.

According to an actual practice, the above-mentioned band clips are manually wound around a wiring harness, a cable or the like and then manually tightened. Accordingly, there is a need for an apparatus to at least semi-automatically wind and tighten a band clip around a wiring harness or the like, in particular, a band clip of the kind as shown in FIGS. 1 and 2, in which the clipping direction and the receiving direction of a band receiving portion are substantially parallel to each other.

It is an object of the present invention to provide an apparatus for winding and tightening a band clip around a wiring harness in such a manner that at least partial automation is possible, thus allowing more regular and efficient use of such band clips.

SUMMARY OF THE INVENTION

An apparatus according to the invention comprises a base member with a clip retaining means for retaining a clip portion of a band clip. Preferably, the clip retaining means is formed such that the clip portion of the band clip can be accommodated in a manner substantially similar to the manner that it will be introduced into an opening formed in, e.g. a portion of a body of a motor vehicle so as to fix the wiring harness to, for instance, this portion o f the motor vehicle. Thus, it is preferred that the clip portion of the band clip be introduced into the base member by pushing the clip portion in the clipping direction into the clip retaining means. The band clip further comprises a receiving portion or opening for receiving the band tip. The band receiving direction and the clipping direction are substantially parallel to each other. The inventive apparatus also includes a band tip deflecting member which is movable with respect to the base member. The tip deflecting member is intended to deflect the band tip around the wiring harness, and also to deflect the band tip towards and through the band receiving portion by reducing the distance between the base member and the band tip deflecting member. In particular, the band tip deflecting member is intended on one hand for turning or returning the band tip, and on the other hand for directing the band tip towards the band receiving portion of the band clip. Preferably, the band tip is deflected by a gliding or sliding engagement of the band tip with the band tip deflecting member. The inventive apparatus also comprises a band tightening member which is movable with respect to the base member. In particular, the band tightening member is provided on a side opposite from the band tip deflecting member with respect to the base member or clip retaining means and is movable independently thereof. The band tightening member is provided for gripping and pulling the band tip after the band tip passes both the band receiving portion and the clip retaining means in the base member. The band tightening member operates by increasing the distance to the base member, thereby tightening the band around the wiring harness or the like.

Accordingly, the present invention provides an apparatus for winding and tightening band clips around a wiring harness in a more regular manner and enabling at least a certain degree of automation.

Preferably, the band tip deflecting member includes a band guiding groove, in particular following a curved path. By providing the band tip deflecting member with a band guiding groove, in particular having approximately or substantially the same widths as the band portion of the band clip, the band tip can be more accurately guided and deflected so as to be directed towards the band receiving portion. The band guiding grooves take a curved path, in particular an elliptic or substantially semi-circular path, such that the band received in and guided along the band guiding groove is deflected to substantially be returned or make a U-turn. As a result, the band tip is directed back to the band receiving port ion which is located adjacent to the end of the band portion toward the clip portion. Most preferably, the leading end of the band tip deflecting member is so formed as to be angled or tilted continuously with the remaining portion of the band tip deflecting member so as to deflect the band more than about 180°. An amount by which the angle of deflection is larger than 180° is dependent on the distance between the band tip deflecting member and the base member as well as the length of the band portion of the band clip.

Although the band tightening member is described herein as a part of the inventive apparatus, it is contemplated that the band tightening member involves an independent inventive idea. The band tightening member may be opened by contacting the base member and may close to grip the band tip that has passed the band receiving portion by moving away from the base member and thereby cancelling the contact. Of course, the band tightening member may perform the above operation not by being brought into direct contact with the base member, but by being brought into contact with a ring or a plate member having an opening provided between the base member and the band tightening member. In any case, the thus featured band tightening member allows automatic gripping and tightening of the band tip and band portion, respectively.

The band tightening member, regardless of whether it is incorporated into the inventive apparatus or forms an independent inventive device, is preferably spring-biased and more preferably self-adjusting the gripping force such that it is proportional to a pulling force which acts to increase the distance of the band tightening member with respect to the base member or other means including a through hole such as the clip retaining means.

According to a preferred embodiment, the band tightening member is comprised of two gripping claws which are so mounted as to form a scissor-like structure, wherein a rotational axis of the gripping claws is guided along a long hole, particularly spring-biased therealong. Accordingly, when the gripping claws of the band tightening member are urged against a surface, they are spaced from each other. When the band tightening member is moved or pulled, the gripping claws will automatically grip an object, in particular a band tip located therebetween by a combined action of the scissor-like construction and the biasing force of the biasing means.

The inventive apparatus may further include a band guiding member for guiding the band or band portion turned between the band tip deflecting member and the base member. The band guiding member is movable, in particular rotatable with respect to the base member between an operable position where it guides the band portion and a retracted position where it is retracted so as not to interfere the movement of the band tip deflecting member. The band guiding member is preferably movable or positionable so as to further guide and hold the deflected band tip when reaching the band receiving portion or while travelling from the band tip deflecting member towards the band receiving portion. Accordingly, it is possible to prevent the occurrence of an incorrect guiding and thus incorrect insertion of the band tip in the band receiving portion. As mentioned above, the band guiding member should, however, be retractable from a travelling path of the band before the band clip is tightened to the wiring harness.

According to a preferred embodiment, the band guiding member includes a band guiding plate which is, in particular, sloped or curved and interposable between a band base portion which is a portion of the band portion adjacent to the clip portion and the band receiving portion. The thickness of the band guiding plate should substantially correspond to a spacing between the band base portion and the band receiving portion. By providing the sloped or curved band guiding plate, the band tip can be directed accurately towards the band receiving portion without providing the deflection of more than 180 degrees by the band tip deflecting member. Thus, the band tip reaches the band receiving portion in a direction substantially parallel to the extension of the band base portion. To enhance the guiding ability, the band guiding member may further comprise a contact portion, provided perpendicular and/or parallel to the band guiding plate.

To further increase the possibility of automation, the inventive apparatus may further comprise cutting means for cutting a redundant band portion having passed the band receiving portion. The cutting means preferably comprises an actuatable cutting blade which is movable with respect to the base member. According to a preferred embodiment, the blade is mounted on the base member, in particular rotatably by means of a bearing. Accordingly, the redundant band portion can be cut by moving the cutting blade with respect to the base member, in particular, by the interaction of an edge of the clip retaining means interacting and the blade.

The inventive apparatus preferably includes drive means, in particular fluid drive means for causing a relative movement of the respective movable members, i.e. of the deflecting member, the band tightening member, the band guiding member and/or the cutting means with respect to the base member. In particular, all drive means with the exception of the one for the band guiding member are intended to provide linear movement, whereas the drive means of the band guiding member is preferably intended for causing a rotational movement thereof. The band guiding member may, however, additionally be provided with drive means for causing a linear movement so as to follow the movement of the band tip after the band tip has left the band tip deflecting member. With this arrangement, the movement of the band tip can be sustained and guided all the way from the band tip deflecting member to the band receiving portion. Preferably, drive axes of the respective drive means extend parallel to each other, such that the respective movements can be controlled or coupled mutually and in a simple manner. Further, by the parallelly arranged drive axes, a major part of the imparted forces can be dealt for driving the movable members. In any case, the provision of drive means allows a high degree of automation with highly accurate control and the possibility of tightening the band clip with high forces.

Finally, it is preferred that the apparatus be portable and, accordingly, provided with a handle mounted on the base member. To configure the apparatus such that it is also usable in a highly occupied work environment such as a work environment for the formation of sophisticated wiring harnesses, the band tip deflecting member should be so mounted on the base member as to project. The dimensions of the band tip deflecting member should be selected according to a desired wiring harness to allow an operator to simply introduce or hook the band tip deflecting member to the portion of the wiring harness which is to be equipped with the band clip. Accordingly, it is preferred that the handle extend in a direction opposite to the projection direction of the band tip deflecting member in order to ensure most suitable and comfortable operability of the apparatus. Further, the movements and the operational or drive axes of the apparatus extend also substantially parallel to the handle, such that an operator using the apparatus can easily cope with the occurring forces, thrusts and moments.

Although the invention is directed mainly to an apparatus, a method defined by the use of the apparatus as well as the independently inventive band tightening member also should be considered to be embraced by the scope of the inventive apparatus. These features as well as other objects, features and benefits of the invention will be described in detail in the following description of one preferred embodiment as well as of the use and method thereof, taking reference to the annexed drawings.

DETAILED DESCRIPTION OF THE PREFERRED EMBODIMENTS

Figure 1:
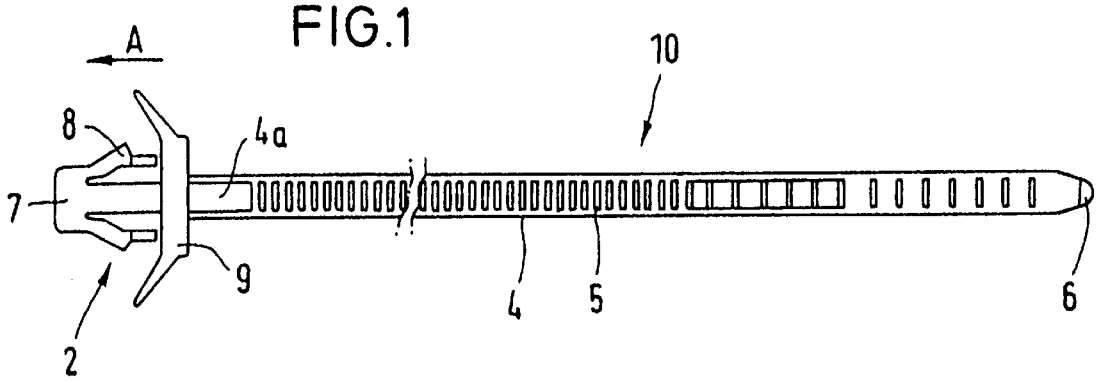
FIG. 1 is a plan view of a band clip to be used with an inventive apparatus, shown in its unapplied state.

With reference to FIG. 1, a band clip 10 is comprised substantially of a clipping portion 2 and a band portion 4. The clipping portion 2 is intended to be inserted and clipped into an opening or recess of a part such as a panel dash board of a vehicle body. The clipping portion 2 is arranged to be inserted and clipped in a direction indicated by an arrow A and has an inserting end portion or clip head 7 and clipping legs 8. The band clip 10 is further provided with a contact portion 9 including a band receiving portion 3 and an engagement portion 9*a* (see FIG. 2). The band portion 4 of the band clip 10 includes a band base portion 4a adjacent to the contact portion 9, a band tip 6 and projections 5 to be engaged with the engagement portion 9*a* of the contact portion 9.

Figure 2:
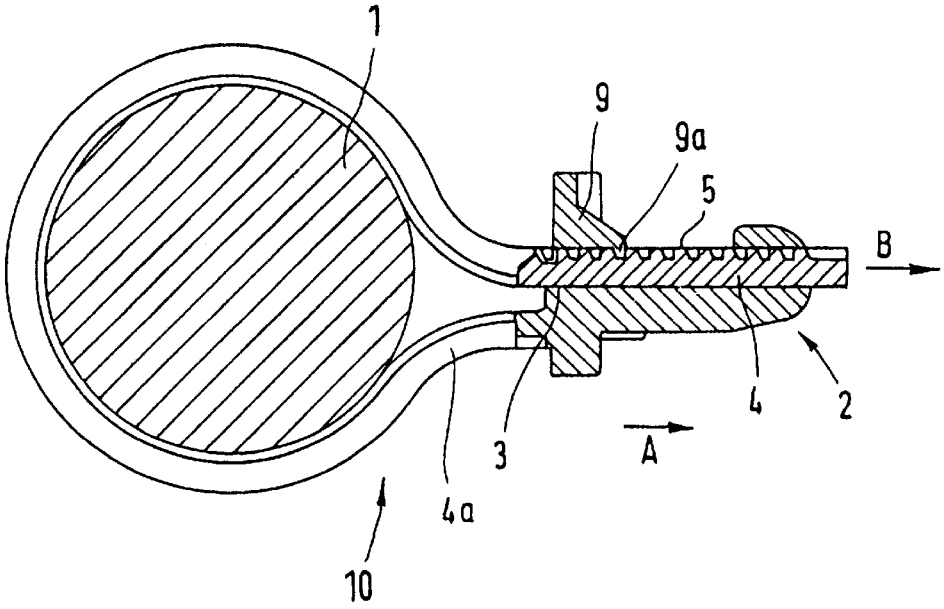
FIG. 2 is a sectional side view of the band clip shown in FIG. 1 in a state wound on a wiring harness.

In FIG. 2, the band clip shown in FIG. 1 is wound around a wire or wiring harness 1. As shown in FIG. 2, the contact portion 9 includes the band receiving portion 3, into which the band tip 6 and the band portion 4 can be inserted in a direction indicated by an arrow B, which is substantially parallel to the insertion or clipping direction of the band clip 10 indicated by the arrow A. As described above, the contact portion 9 also is provided with the engagement portion 9*a* for interacting with the projections 5 formed on the band portion 4 to lock the position of the band portion 4.

Figure 3:
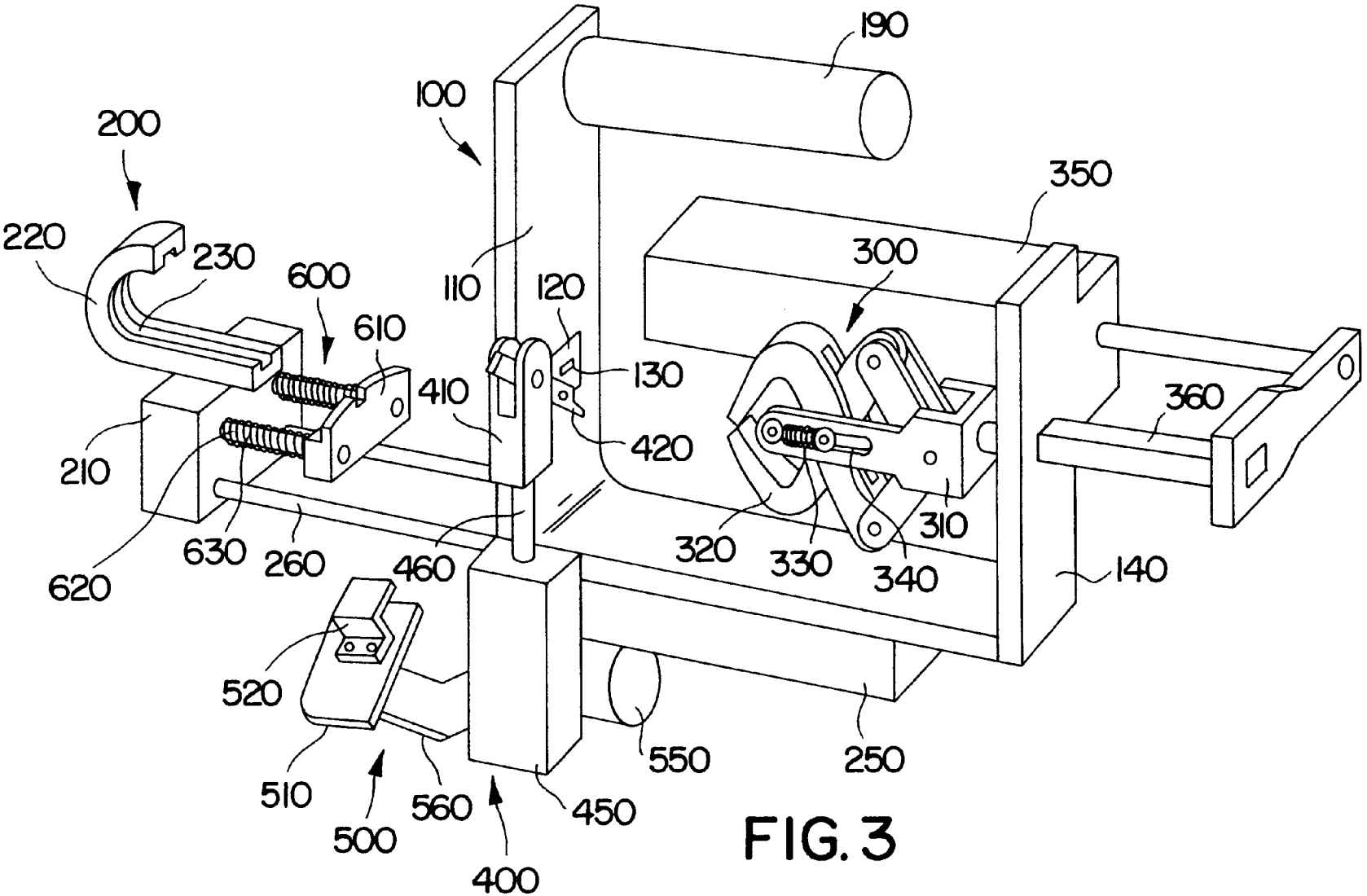
FIG. 3 is a perspective view of a preferred embodiment of the invention.

In FIG. 3, there is shown one preferred embodiment of the inventive apparatus, comprising a base member 100, a band tip deflecting member 200 and a band tightening member 300. This apparatus is further provided with optional band guiding means 500 and 600 and cutting means 400. The base member 100 is shown as a U-shaped member having two leg portions 110 and 140. The leg portion 110 includes an integrated clip retaining means 120 having a through hole 130. The through hole 130 has a special configuration, as will be described later, and is in particular stepped or tapered, wherein the opening shown in this view corresponds substantially in form and size to the band portion of the band clip which is to be handled and is substantially aligned with the band receiving portion of the band clip inserted or clipped from the other side (not illustrated in this view). The band tip deflecting member 200 is movably mounted with respect to the base member 100 via a drive means 250 which is affixed to the base member 100. The drive means 250 is in the shown embodiment a fluid drive means having two extendable rods 260 having distal ends thereof linked with a mounting portion 210. On the mounting portion 210 is mounted a hook-like element 220 which actually is adapted to deflect the band tip in a desired manner. The hook-like element 220 is substantially J-formed and aligned with a direction of movement of the extendable rods 260. The hook-like element 220, in the shown embodiment, is formed with a groove 230 for receiving and guiding the band tip 6 and band portion 4 of the band clip 10. The hook-like element 220 forms a curved path which is substantially semi-circular. However, the look-alike element 220 also could be elliptic or of any other suitable shape to provide the required deflection. As will be discussed later, the curved path extends over more than 180°, such that the deflection will cause the band portion 4 to make a substantial U-turn. By which degrees the above angle exceeds 180° depends on a distance of the band tip deflecting means 200 to the base member 100.

The mounting portion 210 is equipped further with a movably mounted band supporting or guiding member 600. The band supporting member 600 includes a band supporting element 610 provided with a recess substantially corresponding to the form and size of the band portion 4 of the band clip 10 to be used with the apparatus of this embodiment. The band supporting element 610 extends substantially parallel to the mounting portion 210 of the band tip deflecting member 200 and is mounted on the mounting portion 210 via slide rods 620 extending through the mounting portion 210. To hold the band supporting portion 610 spaced apart from the hook-like element 220, the slide rods 620 are biased by springs 630. Instead of the illustrated springs 630, the slide rods 620 may also be provided with a catch such that upon movement of the mounting portion 210 in a direction remote from the base member 100, the band supporting portion 610 is moved remote from the mounting portion 210.

On the other leg portion 140 of the base member 100 the band tightening member 300 is mounted movably and is connected via a link member 360 with a drive means 350 which is also, in the illustrated embodiment, a fluid drive means. The fluid drive means 350 provides a linearly reciprocating movement of the link member 360 and accordingly of the entire band tightening member 300. The band tightening member 300 includes a mounting portion 310 secured to the link member 360. The mounting portion 310 is formed with a long hole 340 for bearing a scissor-like pair of claws 320 for gripping and tightening the band portion 4 as will be described later together with further details of the band tightening member 300 which is considered to be inventive independently of the entire apparatus. The band tightening member 300 is biased by means of a spring 330 and is shown in FIG. 3 as being retracted from the base member 100.

Below the drive means 250 of the band tip deflecting member 200, an optional band guiding member 500 is mounted on the base member 100 via a drive means 550. The drive means 550 is a rotation drive means such as an electrical motor or a fluid driven rotation drive means. The guiding member 500 includes a pivotal lever 560 having at its distal end a band guiding plate 510. On the upper surface of the band guiding plate 510 is mounted a contact portion 520 having in the illustrated embodiment, a contact wall extending substantially perpendicular to the band guiding plate 510 and a contact wall extending substantially parallel thereto.

The cutting means 400 is mounted on the base member 100 via a drive means 450 which, in the illustrated embodiment, is a fluid drive means for causing a linear reciprocating movement of an extendable and contractible rod 460. At an upper portion of the rod 460, a mounting portion 410 is provided to mount a blade 420. The blade 420 also is supported on the leg portion 110 of the base member 100 such that upon contraction of the rod 460, the blade 420 can be pivoted to cross the opening of the through hole 130, thereby cutting a portion of the band portion 4 projecting therefrom.

The apparatus shown in FIG. 3 also is provided with a handle 190 mounted on the base member 100. It should be noted that the handle 190 is mounted to extend in a direction opposite from the direction in which the band tip deflecting member 200 projects and is movable with respect to the base member 100. The handle 190 is advantageous in easily handling the apparatus in processing complicated wiring harnesses when the hook-like element 220 needs to be accurately positioned in a restricted space.

Herebelow, further details of the respective parts of the inventive apparatus are described with reference to FIGS. 4 to 11. In the following description, a method for winding and tightening the band clip with the inventive apparatus and the use of the inventive apparatus are both considered to be also inventive.

Figure 4:
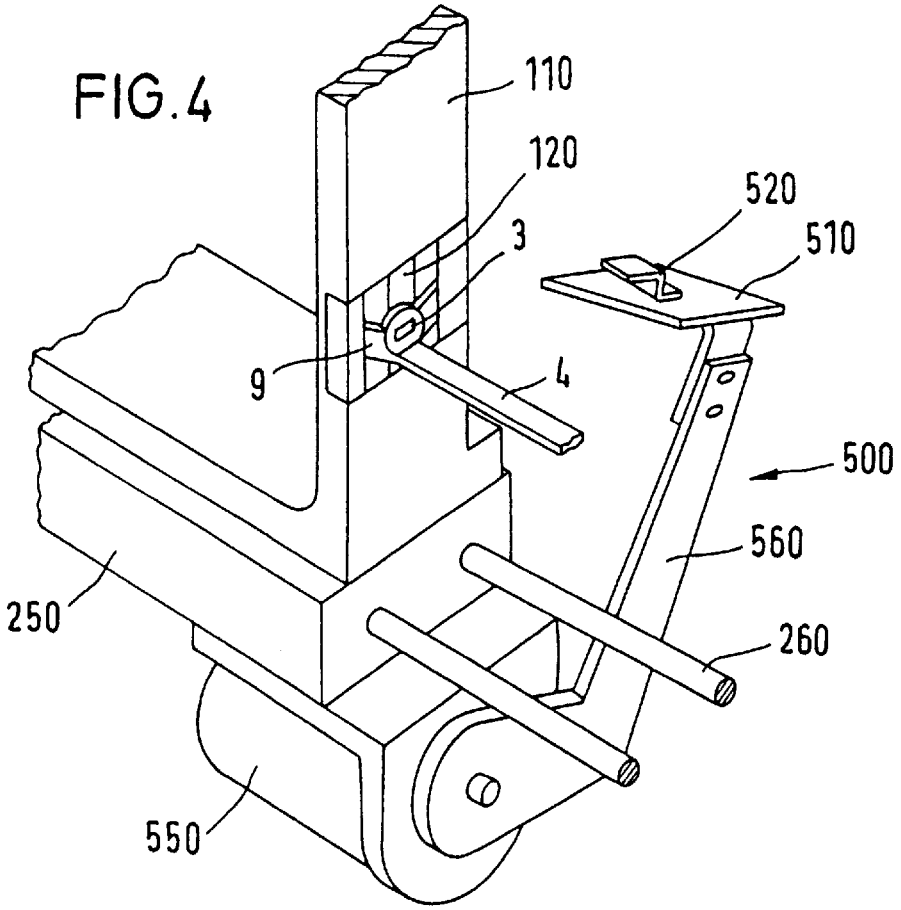
FIG. 4 is a partial perspective view of the apparatus shown in FIG. 3, showing details of a band guiding member and a clip retaining means having a band clip inserted therein.

In FIG. 4, there is shown a partial perspective view of the apparatus shown in FIG. 3. In FIG. 4, the clip retaining means 120 and the band guiding member 500 are shown in detail. The band clip 10 is inserted and clipped in the clip retaining means 120. The band guiding member 500 is in its retracted position, i.e. inoperative position where the guiding plate 510 and the contact portion 520 are remote from the base member 100 or the travelling path of the band portion 4. As shown in FIG. 4, the band clip 10 is inserted such that the contact portion 9 abuts against the clip retaining means 120 and, in this state, the band receiving portion 3 and the band base portion 4*a* extend substantially parallel to each other and perpendicular to the leg portion 110 of the base member 100.

Figure 5:
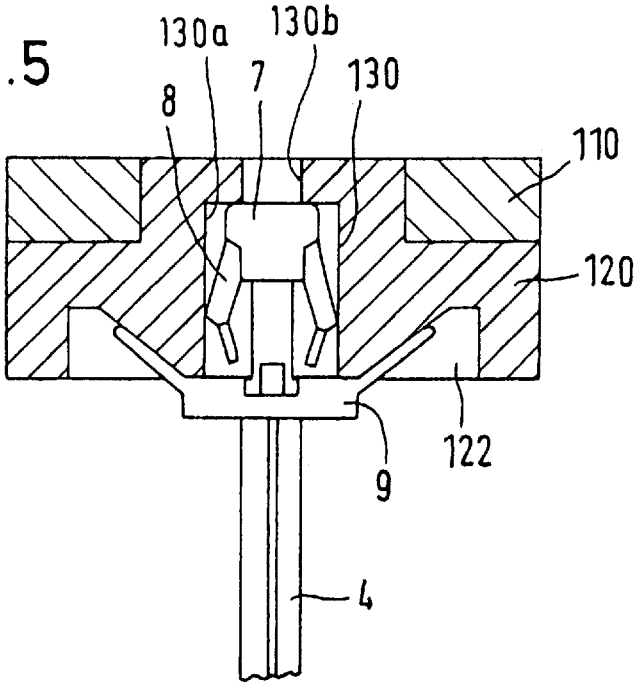
FIG. 5 is a sectional view of the clip retaining means of a base member having the band clip inserted therein.

FIG. 5 is a detailed sectional view of the clip retaining means 120 with the band clip 10 inserted therein. As can clearly be seen in FIG. 5, the through hole 130 is stepped, thus defining a larger portion 130*a* for accommodating the clip head 7 and the clipping legs 8 and a smaller portion corresponding substantially to the size of the band portion 4. The larger portion 130*a* has such a diameter as to accommodate the clipping legs 8 while deforming them. The band clip 10 is fixed by the elastic restoring force of the clipping legs 8. Further, the clip retaining means 120 is provided with recesses 122 for accommodating a part of the contact portion 9, thereby positioning the inserted band clip 10.

Figure 6:
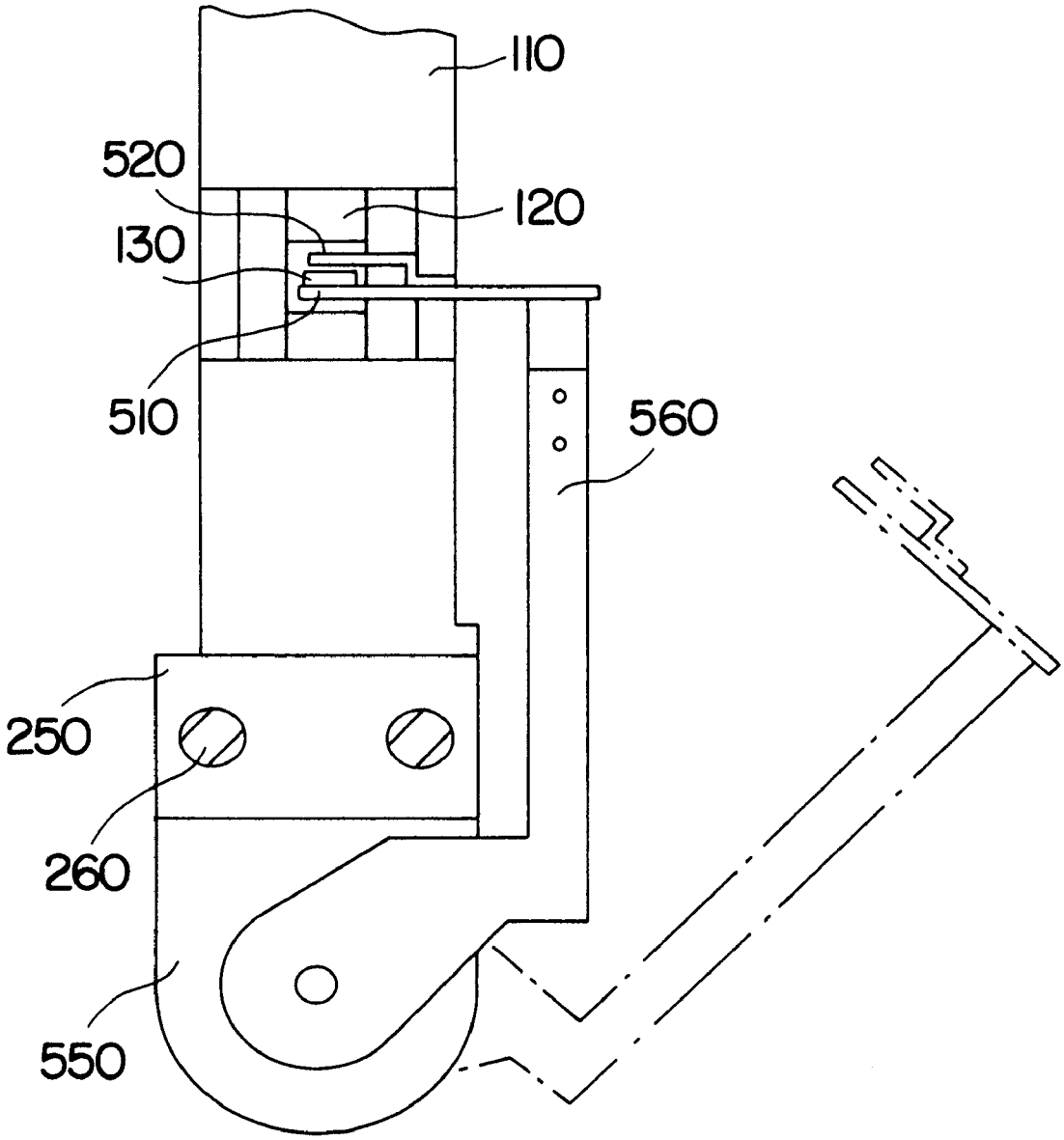
FIG. 6 is an elevational view partly in section showing the band guiding member in two different rotational positions, namely in an operative position shown in solid line for guiding the band portion and a retracted position shown in phantom line.

FIG. 6 shows the band guiding member 500 in detail. Additionally, the leg portion 110 of the base member 100 with the clip retaining means 120 is illustrated in a side view without any band clip inserted. The lever 560, in its operative position, is shown in solid line in FIG. 6, with the guiding plate 510 secured to or mounted on the lever 560 extending substantially in register with the through hole 130, in particular with the smaller portion 130*b*. As shown in FIG. 6, the contact portion 520 is so positioned as to delimit the upper end of the through hole 130 which will correspond to the band receiving portion 3 of the band clip 10 when the band receiving portion 3 is inserted in the clip retaining means 120. As will be described later, it is necessary to remove the band guiding plate 510 out of the travelling path of the band portion 4 to fully tighten the band clip 10 around the wiring harness 1. Accordingly, the lever 560 and the associated band guiding plate 510 are shifted to the inoperative position shown in phantom line in FIG. 6.

Figure 7:
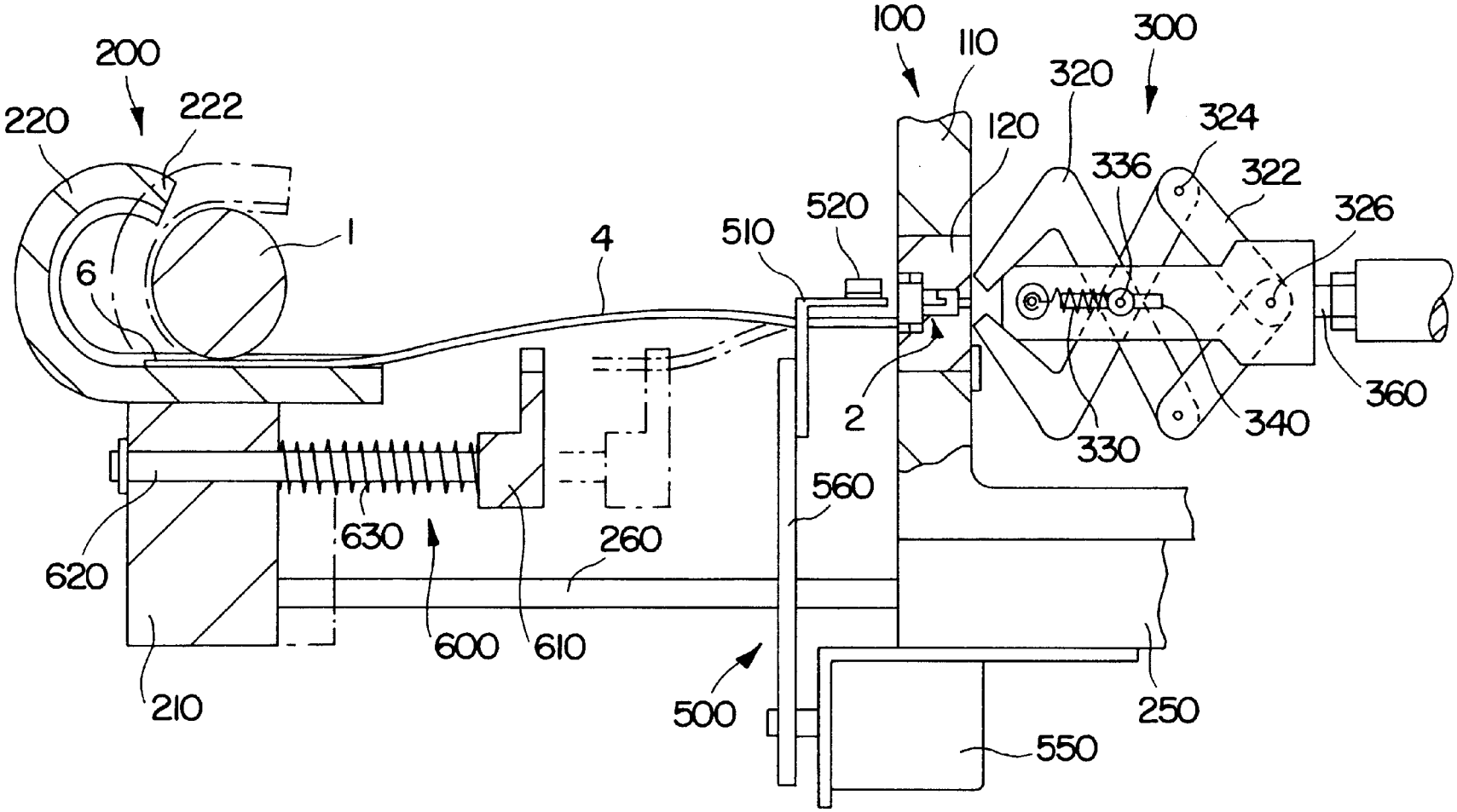
FIG. 7 is an elevational view partly in section of the apparatus shown in FIG. 1, in a state after the insertion of the band clip in the clip retaining means, but before the occurrence of any deflection.

FIG. 7 is a schematic view of the apparatus shown in FIG. 3. This schematic view is partly in section to show relevant details of the apparatus in a state where the clipping portion 2 of the band clip 10 is inserted in the clip retaining means 120. The rods 260 that support the mounting portion 210 of the band tip deflecting member 200 are shown in their extended position, and the band tip 6 is shown resting on a planar portion of the hook-like element 220. The band tightening member 300 is shown in contact with the base member 100 where it is ready to receive, grip and tighten the band tip 6 having passed through the band receiving portion 3 of the band clip 10 and the through hole 130 of the clip retaining means 120. By being brought into contact with the base member 100, the gripping claws 320 of the band tightening member 300 are held open against the action of the spring 330. It should be appreciated from this view that the band tightening member 300 has a scissor-like configuration with one fixed support shaft 326 for mounting two levers 322 which are linked respectively with the gripping claws 320.

The gripping claws 320 are linked with each other by a support shaft 336 provided with a bearing which is movably, in particular shiftably mounted in the long hole 340. Accordingly, when the band tightening member 300 is pressed by a movement of the linking member 360 against the base member 100, the claws 320 are urged into their open state. Upon applying a pulling force to the linking member 360, the gripping claws 320 are brought out of contact with the base member 100 and accordingly will approach each other, thereby gripping a band or other material therebetween. Upon applying further force to the linking member 360, the gripping force of the claws 320 is adjusted automatically in proportion to the pulling force.

One can recognize in FIG. 7 that the apparatus having the band clip inserted is positioned with respect to the wiring harness 1. Further, the band supporting member 600 is shown ready to support the band portion 4 to, prevent the band portion 4 from hanging downwardly in the event that the band portion 4 is long and, in a worst case, from being trapped between the base member 100 and the band tip deflecting member 200 upon actuation of the drive means 250 to reduce a distance between the base member 100 and the band tip deflecting member 200. Upon the above-mentioned actuation of the drive means 250, the band supporting member 600 is moved towards the base member 100 in concert with the band tip deflecting member 200, as illustrated in phantom line. The band guiding member 500 is illustrated in the operative position, i.e. where the lever 560 is positioned upright such that the band guiding plate 510 is positioned above the band base portion 4*a*. Accordingly, when the drive means 250 is actuated to retract the rods 260, the mounting portion 210 and the associated band tip deflecting member 200 will move towards the base member 100. One will recognize that the band tip 6 will follow the curved path defined by the hook-like element 220 upon such movement, as the band clip 10 is held by the clip retaining means 120. The band tip 6 will leave the hook-like element 220 at a directing end portion 222 which directs the band tip 6 towards the band guiding plate 510 with the contact portion 520 so that the band tip 6 will enter the band receiving portion 3 and pass through the through hole 130 of the clip retaining means 120. Normally, since the wiring harness 1 is thicker than the distance between the starting point of the band 4 and the band receiving portion 3, the directing end portion 222 of the hook-like element 220 directs or deflects the band tip 6 downwardly. In other words, the total deflection is somewhat larger than 180 degrees and by which degrees it exceeds 180° depends on the size of the band clip 10 and the wiring harness 1.

Figure 8:
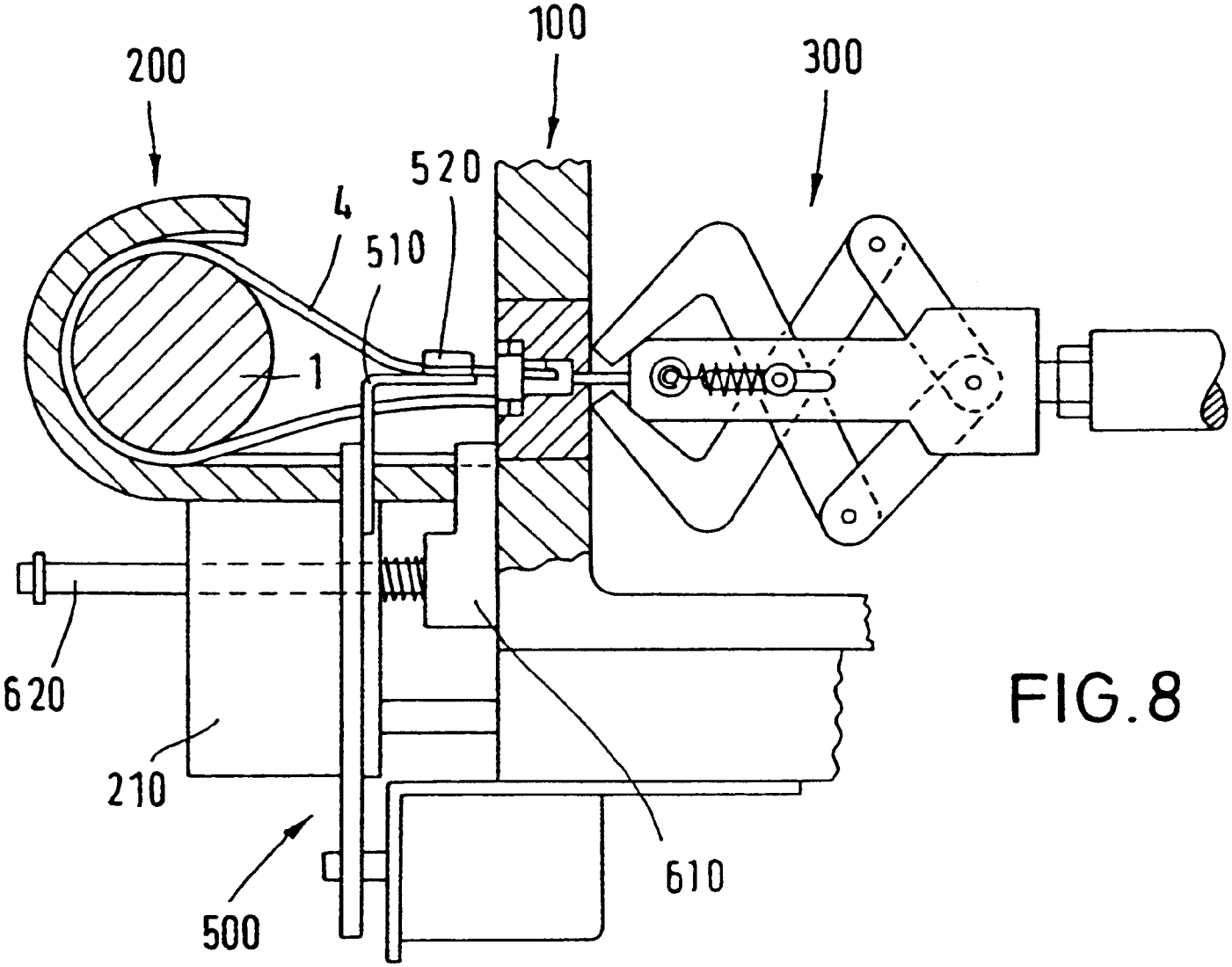
FIG. 8 is a view similar to FIG. 7 showing a state where the band is deflected around a wiring harness and the band tip is inserted in the band receiving portion.

FIG. 8 is a schematic partial view partly in section of the apparatus of the preferred embodiment. In the illustrated shown state, the band tip deflecting member 200 is located in vicinity of the base member 100 to the degree that the band portion 4 entirely surrounds the wiring harness 1, rests on the band guiding plate 510 of the band guiding member 500 and passes through the band receiving portion 3 and the through hole 130 of the clip retaining means 120, and the band tip 6 is positioned between the claws 320 of the band tightening member 300. As can be recognized from FIG. 8, in this embodiment, the band supporting portion 610 can be brought into contact with the base member 100 and the front end face of the band tip deflecting member 200.

Figure 9:
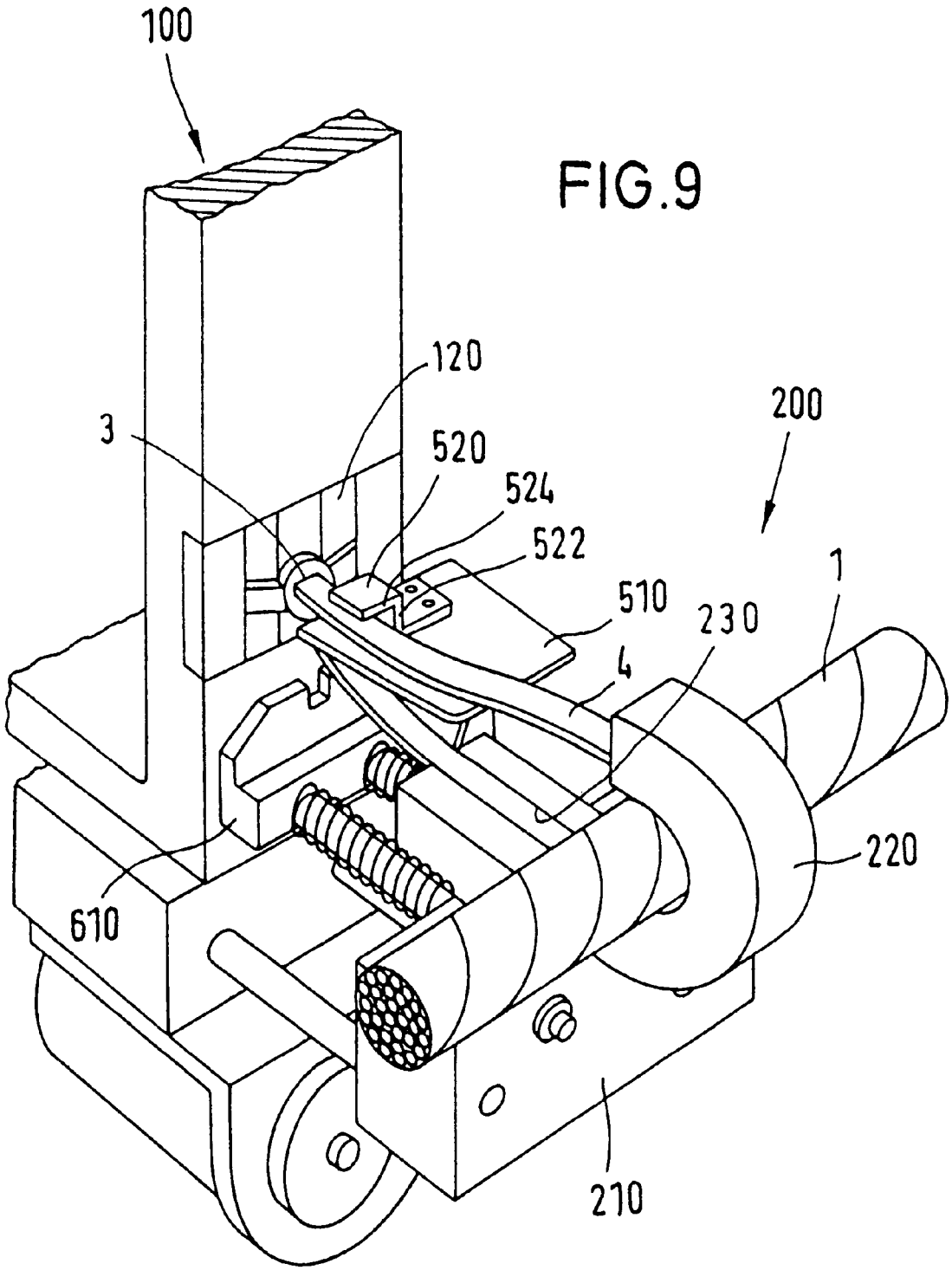
FIG. 9 is a detailed perspective view of the apparatus in the state shown in FIG. 8.

FIG. 9 is a perspective view showing further details of the apparatus according to the preferred embodiment in a state immediately before the one shown in FIG. 8. The hook-like element 220 of the band tip deflecting member 200 surrounds the wiring harness 1 while the band portion 4 of the band clip 10 is interposed therebetween, in particular in the guiding groove 230. The band portion 4 extending from the clip retaining means 120 below the band guiding plate 510 towards the band tip deflecting member 200, is deflected by the band tip deflecting member 200 and returns to the band receiving portion 3 above the band guiding plate 510 while being accurately positioned by the contact portion 520 which comprises one upright wall 522 and one horizontal wall 524 in this embodiment. As shown in this view, the guiding plate 510 is such that the band tip 6 will be deflected once again when touching the band guiding plate 510, thereby entering the band receiving portion 3 substantially in parallel to the band extending direction and in particular to the clipping direction, i.e. the direction in which the clip head 7 is inserted in the clip retaining means 120.

Once the state of FIGS. 8 or 9 is achieved, i.e. once the band tip 6 is inserted in the band receiving portion 3, the band guiding member 500 is moved to the position as illustrated in FIG. 4, i.e. towards the inoperative position.

Figure 10:
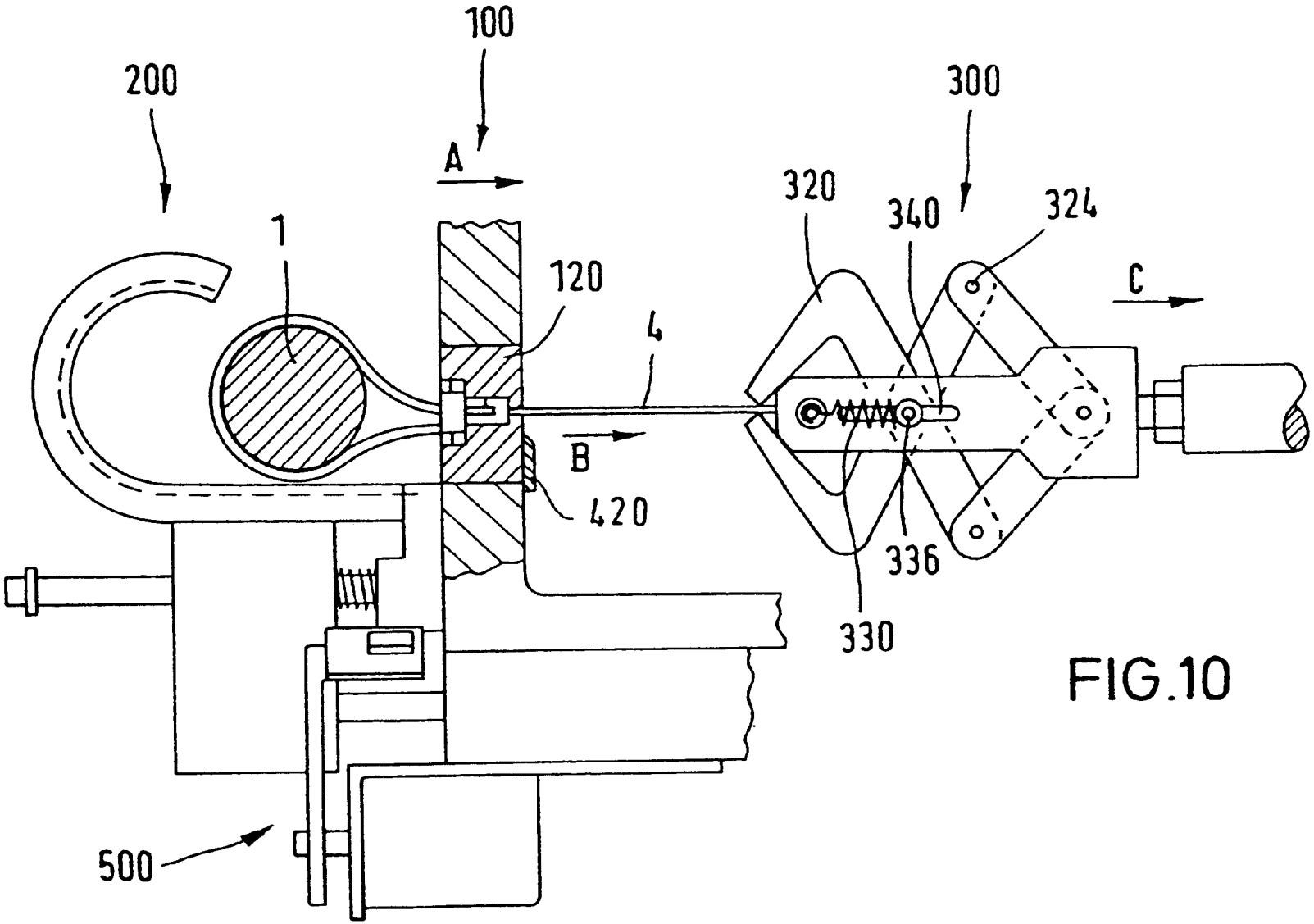
FIG. 10 is a view similar to FIG. 8, showing some elements of the apparatus during or after the tightening of the band clip.

FIG. 10 schematically shows parts of the apparatus according to the preferred embodiment after the guiding member 500 is brought to the inoperative position and after the band tightening member 300 is moved to a position remote from the base member 100. When the band tip 6 is inserted in the band receiving portion 3 and exits the through hole 130 of the clip retaining means 120, the drive means 350 of the band tightening member 300 is actuated such that the gripping claws 320 are brought out of contact of the base member 100 and the claws 320 approach each other by the action of the spring 330, thereby gripping the band tip 6 therebetween. Upon further movement of the band tightening member 300 in the direction indicated by an arrow C, the gripping force of the band tightening member 300 is increased correspondingly by means of the scissor-like construction, the movable support shaft 336 and the long hole 340. Accordingly, the band portion 4 is pulled, thus being tightened around the wiring harness 1, and consequently the wiring harness 1 is released from the band tip deflecting member 200. In this context, it is to be noted that the opening of the hook-like element 220 of the band tip deflecting member 200 is dimensioned such that the wiring harness 1 surrounded with the band clip 10 is not retained therein. Thus, the wiring harness 1 will not be damaged.

Figure 11:
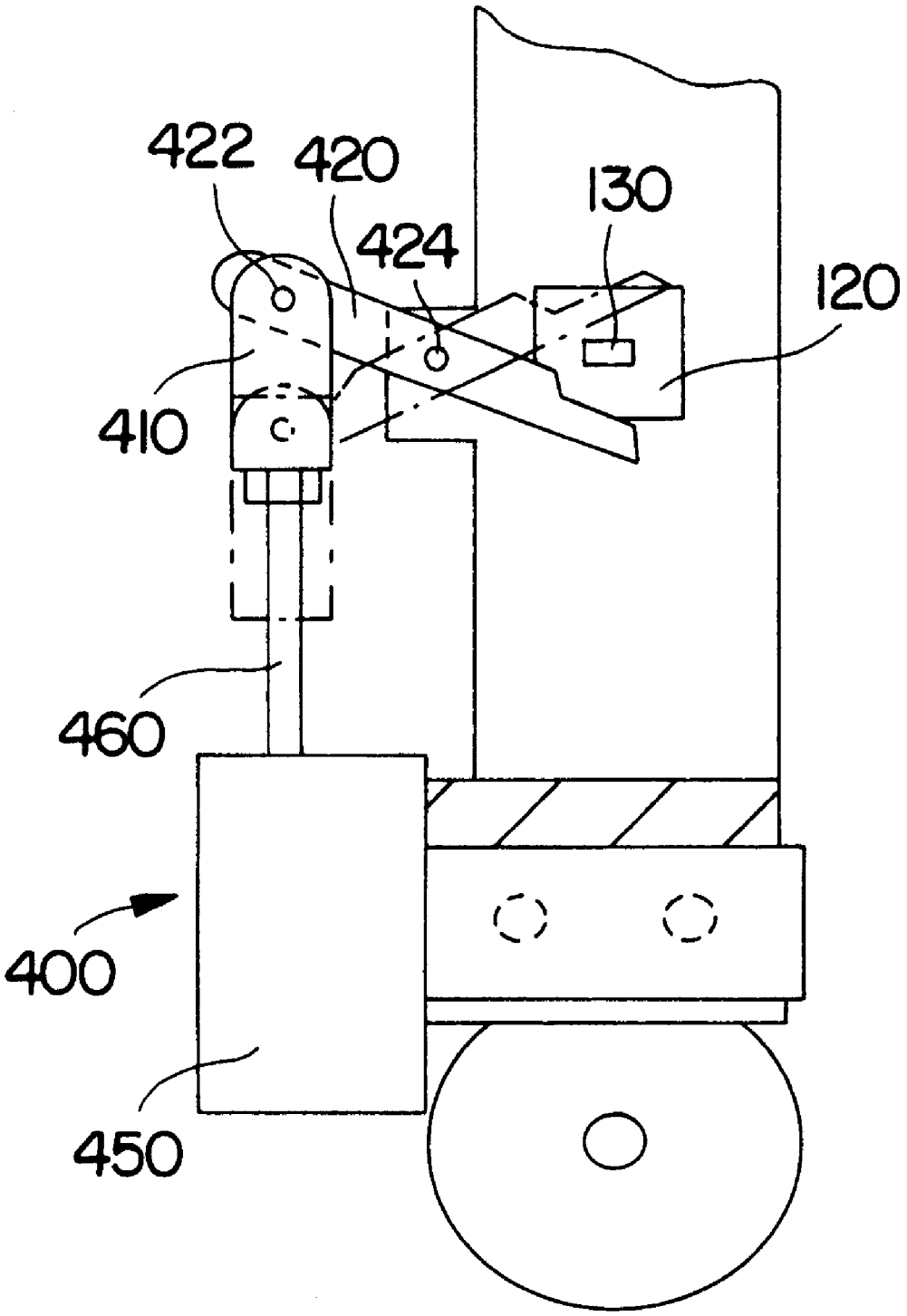
FIG. 11 is a detailed view of an optional cutting means for cutting a redundant portion of the band clip after tightening.

After the state of FIG. 10 is achieved, i.e. the band clip 10 is fully tightened around the wiring harness 1, the cutting means 400 is actuated as illustrated in FIG. 11. As shown in FIG. 11, the cutting means 400 includes the drive means 450 for driving the rod 460. At the distal end of the rod 460, the mounting portion 410 is provided with a support shaft 422 provided with a bearing for supporting one end of the blade 420. The blade 420 is pivotally mounted on the base member 100 via a support shaft 424 also provided with a bearing such that it acts to cut the redundant portion of the band 4 in cooperation with the edge of the through hole 130 upon retraction of the rod 460.

Herebelow, the method and use of the inventive apparatus as well as the band tightening member 300 are described with reference to FIGS. 3 to 11. First of all, the apparatus is put in the state as shown in FIG. 3, i.e. the band tightening member 300 is in the remote position with respect to the base member 100; the band tip deflecting member 200 is set in the remote position with respect to the base member 100; the band supporting member 600 is set in a position remote from the band tip deflecting member 200 or in a position between the band tip deflecting member 200 and the base member 100; the band guiding member 500 is set in its inoperative position; and the cutting means 400 is set in its initial position where the blade 420 thereof is located below the through hole 130 of the clip retaining means 120.

Thereafter, as shown in FIGS. 4 and 5, a band clip 10, as illustrated in FIGS. 1 and 2, is insertably positioned and clipped in the retaining means 120, and the band guiding member 500 is brought into the operative position by actuating the drive means 550 such as an air rotor. Accordingly, the band guiding plate 510 is positioned above the band portion 4 as shown in FIG. 7. The band tip 6 rests on a planar portion of the band tip deflecting member 200 and optionally on the band supporting member 600.

Now an operator holding the apparatus by the handle 190 positions the hook-like element 220 with the band tip 6 therein with respect to the wiring harness 1 as illustrated in FIG. 7. Once this state is achieved, the drive means 250 such as a fluid cylinder is actuated to retract the rod 260 such that the band tip deflecting member 200 is moved towards the base member 100. During this movement, the band tip 6 is deflected by the hook-like element 220 while being guided along the groove 230. Accordingly, during the movement of the band tip deflecting member 200, the band portion 4 comes to take a such substantially U-shaped configuration as to be returned towards the base member 100. As the end portion 222 of the hook-like element 220 deflects the band portion 4 by more than 180°, the band tip 6 is directed somewhat downwardly. Upon further movement of the band tip deflecting member 200, the band tip 6 reaches the band guiding plate 510 of the band guiding member 500. Upon reaching the band guiding plate 510, the band tip 6 is in contact with the contact portion 520 such that the band tip 6 can accurately enter the band receiving portion 3 of the band clip 10 and pass therethrough and subsequently through the through hole 130 of the clip retaining means 120. This is the state shown in FIG. 8 in which the band tip 6 is positioned between the released claws 320 of the band tightening member 300.

Once the above state is achieved, the band guiding member 500 is brought to the inoperative position by actuating the drive means 550 in the opposite direction. As soon as the band guiding member 500 is brought to the inoperative position, the drive means 350 is actuated to bring the band tightening member 300 out of contact with the base member 100 so that the claws 320 automatically grip the band tip 6 located therebetween. By a further actuation of the drive means 350, the band portion 4 of the band clip 10 is pulled through the band receiving portion 3 of the band clip 10, wherein the gripping force of the claws 320 is automatically adjusted. Accordingly, the band clip 10 is tightened around the wiring harness 1, thereby pulling it out of engagement with the hook-like element 220 of the band tip deflecting member 200 as illustrated in FIG. 10.

Once the band clip 10 is fully tightened around the wiring harness 1, the cutting means 400 is actuated as illustrated in FIG. 11 to bring the blade 420 to the position illustrated in phantom line to cut a redundant portion of the band clip 10, i.e. a portion of the band clip projecting from the band receiving portion 3. Accordingly, a state as illustrated in FIG. 2 is obtained.

In summary, the inventive apparatus, band tightening member and method allow a high degree of automation, highly regular and uniform winding, and tightening of several band clips around a wiring harness and a high operability in connection with the production of wiring harnesses where a minimum working space is sometimes available for winding and tightening the band clips.

What is claimed is:

1. Apparatus for winding and tightening a band clip around a wiring harness, said band clip having a tip at one end and a clip portion at an opposed end, a band portion extending from said tip toward said clip portion, a band receiving portion in proximity to said clip portion and being configured for receiving said tip and at least a section of said band portion inserted therethrough in a receiving direction, said apparatus comprising:

a base member with a through hole dimensioned for having said tip and at least a section of said band portion passed therethrough, a clip retainer substantially adjacent said through hole and configured for retaining the clip portion of the band clip inserted into the clip retainer in a clipping direction that is substantially parallel to the receiving direction;

a band tip deflecting member movable with respect to the base member in a direction substantially parallel to both the clipping direction and the receiving direction for deflecting the band tip of the band clip around the wiring harness towards and through the band receiving portion by reducing a distance between the base member and the band tip deflecting member; and a band tightening member disposed on a side of said base member opposite said band tip deflecting member, said band tightening member being movable with respect to the base member for gripping and pulling the band tip after the band tip has passed the band receiving portion to tighten the band portion by increasing a distance between the base member and the band tightening member.

2. Apparatus according to claim 1, wherein the band tip deflecting member includes a band guiding groove, following a curved path.

3. Apparatus according to claim 1, wherein the band tightening member is opened by contacting the base member and grips the band tip that has passed the band receiving portion upon cancellation of the contact.

4. Apparatus according to claim 3, wherein the band tightening member is spring biased and self-adjusts a gripping force in proportion to a pulling force used to increase the distance between the base member and the band tightening member.

5. Apparatus according to claim 1, further comprising means for cutting a portion of the band portion having passed the band receiving portion, the cutting means comprising an actuatable blade movable with respect to the base member.

6. Apparatus according to claim 5, further comprising drive means for causing relative movement of the band tip deflecting member, the band tightening member and the cutting means with respect to the base member.

7. Apparatus according to claim 1, further comprising a handle mounted to the base member, extending in a direction opposite to the projecting direction of the band tip deflecting member.

8. Apparatus according to claim 1, wherein the band tip deflecting member includes a substantially linear portion aligned substantially parallel to said clipping direction and said receiving direction and a curved portion extending from said linear portion through an arc of at least 180°.

9. Apparatus according to claim 8, wherein said linear portion of said tip deflecting member is disposed at a level lower than said clipping portion of said base member, and wherein said curved portion is disposed above said linear portion.

10. Apparatus for winding and tightening a band clip around a wiring harness, said band clip having a tip at one end and a clipping portion at an opposed end, a band portion extending from the tip toward the clipping portion, a band receiving portion substantially adjacent the clipping portion for receiving the tip and at least a section of the band portion inserted therethrough along a receiving direction, said apparatus comprising:

a base member with a clip retainer configured for retaining the clip portion of the band clip inserted into the clip retainer in a clipping direction that is substantially parallel to the receiving direction;

a band tip deflecting member movable with respect to the base member in a direction substantially parallel to both the clipping direction and the receiving direction for deflecting the band tip of the band clip around the wiring harness towards and through the band receiving portion by reducing a distance between the base member and the band tip deflecting member;

a band tightening member disposed on a side of said base member opposite said band tip deflecting member, said band tightening member being movable with respect to the base member for gripping and pulling the band tip after the band tip has passed the band receiving portion to tighten the band portion by increasing a distance between the base member and the band tightening member; and a band supporting member for supporting the band portion between the base member and the band tip deflecting member, the band supporting member being movable with respect to the band tip deflecting member.

11. Apparatus for winding and tightening a band clip around a wiring harness, said band clip having a tip at one end and a clipping portion at an opposed end, a band portion extending from the tip toward the clipping portion, a band receiving portion substantially adjacent the clipping portion for receiving the tip and at least a section of the band portion along a receiving direction, said apparatus comprising:

a base member with a through hole dimensioned for having said tip and at least a section of said band portion of said band clip passed therethrough, a clip retainer substantially adjacent said through hole and configured for retaining the clip portion of the band clip inserted into the clip retainer in a clipping direction that is substantially parallel to the receiving direction;

a band tip deflecting member movable with respect to the base member in a direction substantially parallel to the clipping direction and the receiving direction for deflecting the band tip of the band clip around the wiring harness towards and through the band receiving portion by reducing a distance between the base member and the band tip deflecting member;

a band tightening member disposed on a side of said base member opposite said band tip deflecting member, said band tightening member being movable with respect to the base member for gripping and pulling the band tip after the band tip has passed the band receiving portion to tighten the band portion by increasing a distance between the base member and the band tightening member; and a band guiding member for guiding the band turned between the band tip deflecting member and the base member, the band guiding member being movable with respect to the base member in a direction substantially transverse to the clipping direction and the receiving direction.

12. Apparatus according to claim 11, wherein the band guiding member comprises a band guiding plate and a contact portion that is spaced from the band guiding plate sufficiently to fit the band portion of the band clip therebetween.

13. Apparatus according to claim 11, wherein the band guiding member is rotatably movable with respect to the base member.

* * * * *